US005188678A

United States Patent [19]

Sekhar et al.

[11] Patent Number: 5,188,678

[45] Date of Patent: Feb. 23, 1993

[54] MANUFACTURE OF NET SHAPED METAL CERAMIC COMPOSITE ENGINEERING COMPONENTS BY SELF-PROPAGATING SYNTHESIS

[75] Inventors: Jainagesh A. Sekhar, Cincinnati, Ohio; Sarit B. Bhaduri, Moscow, Id.; Hung P. Li; Necip S. Canarslan, both of Cincinnati, Ohio

[73] Assignee: University of Cincinnati, Cincinnati, Ohio

[21] Appl. No.: 855,151

[22] Filed: Mar. 20, 1992

Related U.S. Application Data

[63] Continuation of Ser. No. 567,367, Aug. 15, 1990, abandoned.

[51] Int. Cl.[5] ..... C22C 1/05; C22C 1/09

[52] U.S. Cl. ..... 148/514; 148/515; 420/590

[58] Field of Search ..... 148/514, 515; 420/129, 420/590; 428/614

[56] References Cited

U.S. PATENT DOCUMENTS

| | | | |
|---|---|---|---|
| 3,090,094 | 5/1963 | Schwartzwalder et al. | 264/44 |
| 3,097,930 | 7/1963 | Holland | 264/44 |
| 3,893,917 | 7/1975 | Pryor et al. | 75/411 |
| 3,947,363 | 3/1976 | Pryor et al. | 501/80 |
| 3,962,081 | 6/1976 | Yarwood et al. | 75/412 |
| 4,024,056 | 5/1977 | Yarwood et al. | 75/412 |
| 4,081,371 | 3/1978 | Yarwood et al. | 75/412 |
| 4,257,810 | 3/1981 | Narumiya | 75/412 |
| 4,258,099 | 3/1981 | Narumiya | 75/412 |
| 4,391,918 | 7/1983 | Brockmeyer | 501/127 |
| 4,459,363 | 7/1984 | Holt | 501/90 |
| 4,697,632 | 10/1987 | Lirones | 264/44 |
| 4,710,348 | 12/1987 | Brupbacher et al. | 420/129 |
| 4,751,048 | 6/1988 | Christodoulou et al. | 420/129 |
| 4,772,452 | 9/1988 | Brupbacher et al. | 420/129 |
| 4,774,052 | 9/1988 | Nagle et al. | 420/129 |
| 4,800,065 | 1/1989 | Christodoulou et al. | 420/590 |
| 4,836,982 | 6/1989 | Brupbacher et al. | 420/129 |
| 4,909,842 | 3/1990 | Dunmead et al. | 75/236 |
| 4,915,902 | 4/1990 | Brupbacher et al. | 420/129 |
| 4,915,903 | 4/1990 | Brupbacher et al. | 420/129 |
| 4,915,904 | 4/1990 | Christodoulou et al. | 420/590 |
| 4,915,905 | 4/1990 | Kampe et al. | 420/129 |
| 4,915,908 | 4/1990 | Nagle et al. | 420/129 |
| 4,916,029 | 4/1990 | Nagle et al. | 428/614 |
| 4,916,030 | 4/1990 | Christodoulou et al. | 428/614 |
| 4,917,964 | 4/1990 | Moshier et al. | 428/614 |

OTHER PUBLICATIONS

Cutler, R. A., et al., Synthesis and Densification of Oxide-Carbide Composites, pp. 715-727.

McCauley, J. W., et al., Simultaneous Preparation and Self-Sintering of Materials in the System Ti-B-C.

Rice, Roy W., et al., Effects of Self-Propagating Synthesis Reactant Compact Character on Ignition, Propagation and Resultant Microstructure.

Yi-, H. C., et al., Self-Propagating High-Temperature (Combustion) Synthesis (SHS) of Powder-Compacted Materials, Journal of Materials Science, 25, (1990), pp. 1159-1168.

*Primary Examiner*—George Wyszomierski

*Attorney, Agent, or Firm*—Frost & Jacbos

[57] ABSTRACT

The present invention relates to a method of making metal ceramic composites and the metal ceramic compositions and articles made therefrom, especially net-shaped articles having a wide variety of applications.

The present invention involves preparing a combustion synthesis mixture comprising at least one substance containing a combustible mixture of powders and at least one low-melting metal, forming this mixture into a desired final shape in a die, and carrying out a combustion synthesis therewith. Ceramic or metallic reinforcements may be incorporated in the combustion synthesis.

The present invention allows the control of porosity in the resultant composite compositions and can result in composites having high toughness characteristics.

12 Claims, 4 Drawing Sheets

MANUFACTURE OF NET SHAPED METAL CERAMIC COMPOSITE ENGINEERING COMPONENTS BY SELF-PROPAGATING SYNTHESIS

This is a continuation of application Ser. No. 07/567,367 filed Aug. 15, 1990, abandoned.

BACKGROUND OF THE INVENTION

1. Field of the Invention

The present invention relates to a method of making net shaped and near-net shaped metal ceramic composite materials using self-propagating high temperature synthesis (SHS). Also part of the present invention are the materials prepared by such process.

Several generic manufacturing technologies form the backdrop for the present invention. These technologies include casting, deformation processing, powder-based processes (such as sintering) and vapor phase deposition. All of these technologies are highly energy- and labor-intensive, involving several discrete time-consuming operations. In contrast, SHS techniques require no energy input, relatively little labor and allow the entire manufacturing process to be carried in relatively few processing steps.

The production of net shaped or near-net shaped articles by SHS techniques allow articles to be made with little or no post-manufacture machining. No high temperature furnaces are needed for manufacture, rendering the process largely capital insensitive and completely energy insensitive. High production rates are possible and such composites can be reliably produced.

Metal ceramic composite materials are considered as one of the most preferred material types for engineering applications. Current applications include automotive applications and use in aerospace and chemical industries; in general in those engineering environments where wear and erosion properties are important. In the automotive industry, for example, parts made from high temperature composites and monolithic ceramics allow the development of high performance engines, lowering exhaust emissions and giving higher fuel efficiency.

To be considered a candidate for such applications, the component parts must be reliable, requiring materials possessing high toughness and strength, low thermal expansion coefficients and low susceptibility to flaws, environmental degradation, cyclic stresses and temperatures. For wear resistant parts (e.g. bearings, seals, valves, etc.), the materials should have optimized tribological properties in the working environment. Such properties can be met by using materials with high hardness and toughness, chemical inertness and low thermal expansion coefficients.

The methods and composites of the present invention may be used to produce any of a wide variety of engineering components such as tool bits, grinding wheels, engine parts, sports equipment, aerospace parts, pump housings and parts, parts and tools for use in the chemical industry, and other wear-resistant items.

Two approaches have been taken toward the goal of producing materials with the above-outlined properties. The first approach has been to develop monolithic ceramics with application potential in engineering structures. However, many of these materials have undesirable properties. For example, as operating temperatures increase, the toughness of toughened zinconia (one of the best monolithic ceramics developed to date) drops considerably, while conventionally sintered materials creep with disastrous consequences.

The second approach has been to incorporate other phase(s) into a suitable matrix material. It has been expected that such a composite material would benefit from the synergistic improvement of properties derived from the various individual component phases.

Although theoretically attractive, the processing necessary to obtain these composites has been a matter of considerable difficulty and expense of time and energy.

Another aspect of the invention's background involves an appreciation of so-called "net shaped" materials. Net shaped materials offer the advantage of requiring little or no post-synthesis machining to a final shape, tolerance or texture. Accordingly, it is desirable to be able to produce net shaped metal ceramic composite materials for industrial and engineering applications.

An important part of the methodological backdrop of the present invention involves self-propagating high temperature synthesis (SHS). Self-propagating high temperature synthesis, alternatively and more simply termed combustion synthesis, is an efficient and economical process of producing refractory materials. In combustion synthesis processes, materials having sufficiently high heats of formation are synthesized in a combustion wave which, after ignition, spontaneously propagates throughout the reactants converting them into products. The combustion reaction is initiated by either heating a small region of the starting materials to ignition temperature where upon the combustion wave advances throughout the materials, or by bringing the entire compact of starting materials up to the ignition temperature where upon combustion occurs simultaneously throughout the sample in a thermal explosion.

In conventional consolidation methods such as a sintering process, the reaction is initiated and carried out to completion by heat from an external source, such as a furnace. Usually, the heating rate is purposely kept low to avoid large temperature excursions which may cause spalling and bending in ceramics. Material prepared by such conventional methods are relatively expensive due to the high cost of energy and equipment. In the combustion synthesis process, however, after ignition has occurred, the rest of the sample is subsequently heated by the heat liberated in the reaction without the input of further energy. As a result, expensive equipment such as high temperature furnaces, are not required.

Some examples of prior art SHS techniques can be found in the following references:

"Simultaneous Preparation and Self-Sintering of Materials in the System Ti-B-C", J. W. McCauley et al Eng. & Sci. Proceedings, 3, 538–554 (1982), describes self-propagating high temperature synthesis (SHS) techniques using pressed powder mixtures of titanium and boron; titanium, boron and titanium boride ($TiB_2$); and titanium and $B_4C$. Stoichiometric mixtures of titanium and boron were reported to react almost explosively (when initiated by a sparking apparatus) to produce porous, exfoliated structures. Reaction temperatures were higher than 2200° C. Mixtures of titanium, boron and titanium boride reacted in a much more controlled manner, with the products also being very porous. Reactions of titanium with $B_4C$ produced material with much less porosity. Particle size distribution of the titanium powder was found to have an important effect on the process, as was the composition of the mixtures Titanium particle sizes ranging from about 1 to about 200 microns were used.

"Effects of Self-Propagating Synthesis Reactant Compact Character on Ignition, Propagation and Resultant Microstructure", R. W. Rice et al, Ceramic Eng & Sci. Proceedings, 7, 737–749 (1986), describes SHS studies of reactions using titanium powders to produce TiC, $TiB_2$, or $TiC+TiB_2$. Reactant powder compact density was found to be a major factor in the rate of reaction propagation, with the maximum rate being at about 60±10% theoretical density. Reactant particle size and shape were also reported to affect results, with titanium particles of 200 microns, titanium flakes, foil or wire either failing to ignite or exhibiting slower propagation rates. Particle size distribution of powdered materials (Al, B, C, Ti) ranged from 1 to 220 microns. Tests were attempted with composites of continuous graphite tows infiltrated with a titanium slurry, but delamination occurred. Tests with one or a few tows infiltrated with a titanium powder slurry (to form TiC plus excess Ti) were able to indicate a decrease in ignition propagation rates as the thermal conductivity of the environment around the reactants increases, leading to a failure to ignite when local heat losses are too high.

H. C. Yi et al, in *Jour. Materials Science,* 25 1159–1168 (1990), review SHS of powder compacts and conclude that many of the known ceramic materials can be produced by the SHS method for applications such as polishing powders; elements for resistance heating furnaces; high temperature lubricants; neutron alternators; shape-memory alloys; and steel melting additives. The need for considerable further research is acknowledged, and major disadvantages are pointed out. No mention is made of producing these materials in a single step net shaped operation.

This article further reports numerous materials produced by SHS and combustion temperatures for some of them, viz., borides, carbides, carbonitrides, nitrides, silicides, hydrides, intermetallics, chalcogenides and cemented carbides.

Combustion wave propagation rate and combustion temperature are stated to be dependent on stoichiometry of the reactants, pre-heating temperature, particle size and amount of diluent.

U.S. Pat. No. 4,459,363, issued Jul. 10, 1984 to J. B. Holt, discloses synthesis of refractory metal nitride particles by combustion synthesis of an alkali metal or alkaline earth metal azide with magnesium or calcium and an oxide of Group III-A, IV-A, III-B, or IV-B metals (e.g., Ti, Zr, Hf, B and Si), preferably in a nitrogen atmosphere.

U.S. Pat. No. 4,909,842, issued Mar. 20, 1990 to S. D. Dunmead et al, discloses the production of dense, finely grained composite materials comprising ceramic and metallic phases by self-propagating high temperature synthesis (SHS) combined with mechanical pressure applied during or immediately after the SHS reaction. The ceramic phase or phases may be carbides or borides of titanium, zirconium, hafnium, tantalum or niobium, silicon carbide, or boron carbide. Intermetallic phases may be aluminides of nickel, titanium or copper, titanium nickelides, titanium ferrites, or cobalt titanides. Metallic phases may include aluminum, copper, nickel, iron or cobalt. The final product has a density of at least about 95% of the theoretical density only when pressure is applied and comprises generally spherical ceramic grains not greater than about 5 microns in diameter in an intermetallic and/or metallic matrix. Interconnected porosity is not obtained in this product, nor does the process control porosity.

The well known thermit reaction involves igniting a mixture of powdered aluminum and ferric oxide in approximately stoichiometric proportions which reacts exothermically to produce molten iron and aluminum oxide.

All the above-identified references are hereby incorporated by reference.

The method taught by Dunmead, et al requires that the porosity of such composites must be controlled by the necessary application of mechanical pressure during or after the combustion synthesis. However, because this pressure is applied uniaxially, a net shaped article cannot be produced. Also, the required use of applied pressure prevents higher production rates of the subject composites.

In the same regard, the Dunmead, et al reference reports that materials made according to its method without applied pressure yield composites having about 45 to 48 percent porosity. Higher porosity results in less toughened composite products which are susceptible to advance of crack propagation.

It is, therefore, desirable to be able to produce net shaped or near net shaped composite materials whose porosity may be controlled or distributed beneficially without the use of applied pressure. Control of porosity allows composites having increased toughness properties to be produced. Such control also allows the production of composites amenable to impregnation with other materials, such as oil impregnation in bearing surfaces.

It is also desirable to produce such net shaped composite materials to be distortion free and with dimensional reproducibility, in a time- and energy-efficient manner.

SUMMARY OF THE INVENTION

Figure 1:
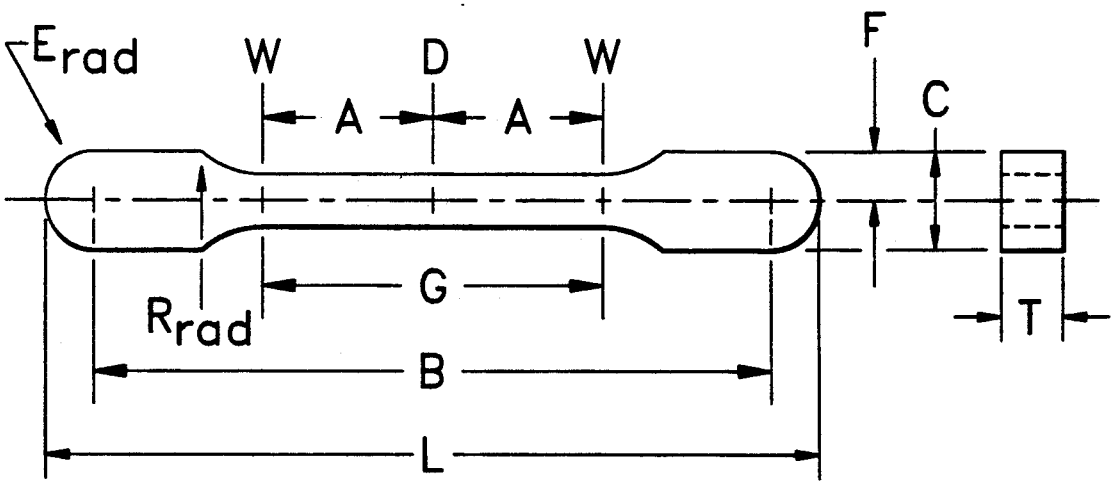
FIG. 1 is a top view of a standard flat tension test specimen produced to test the performance of materials made in accordance with the investigation.

Toward fulfilling the above-described objectives and achieving the desirable properties and characteristics in accordance with the foregoing discussion, the present invention relates to a method of producing metal ceramic composites and the compositions of matter resulting from said method, including net shaped or near-net shaped engineering components.

One of the most important applications of the present invention is in the area of so-called "net shaped" or "near-net shaped" composite materials. Net shape and near-net shaped materials are those which require no or relatively little or minor post-manufacturing processing (such as grinding, polishing, cuffing or deburring). That is, net shaped or near-net shaped materials are those whose final shape and dimensions may be largely or even completely achieved in the manufacturing process itself. For the purposes of this application, both "net shaped" and "near-net shaped" materials are referred to as net shaped material (the difference being largely one of degree).

Some of the important advantages of net shaped composites include, of course, minimizing or eliminating expensive post-manufacturing processing and machinery. Another very important advantage disclosed in this invention is that the subject distortion-free compositions allow the net shaped article to be manufactured in a single operation.

In its most generic form, the method of the present invention comprises preparing a combustion synthesis mixture of (a) at least one substance containing a combustible mixture of powders and (b) at least one low melting metal, and carrying out a combustion synthesis therewith. As used herein, the term "low-melting metal" shall be used to indicate metals melting below about 2,650° C.

The combustible mixture of powders may be any such mixture known to be applicable to the field of combustion synthesis. An example of a combustible mixture of powders is one that would contain a substance containing titanium and boron, such as titanium boride.

The mixture so prepared is then ignited so as to form a metal ceramic composite by combustion synthesis.

It should be noted that since the low-melting metal component and the combustible mixture may both contain metals—such as titanium—the combustible mixture may simply be used alone with an excess of metal in order to practice the invention as there is no requirement that the metal component be added as a separate constituent to the combustible mixture.

The combustion synthesis mixture may optionally contain at least one ceramic reinforcement such as at least one substance selected from the group consisting of oxides, borides, carbides, phosphides, nitrides and silicides, formed by the combustion synthesis reaction. Such a reaction is defined as one wherein the heat of reaction heats up the reactants in front of the products and causes further reaction.

Examples of such products include, but are not limited to:

Borides of titanium, zirconium, niobium, tantalum, molybdenum, hafnium, chromium, and vanadium;

Carbides of titanium, hafnium, boron, aluminum, tantalum, silicon, tungsten, zirconium, niobium, and chromium;

Nitrides of titanium, zirconium, boron, aluminum, silicon, tantalum, hafnium, and niobium;

Silicides of molybdenum, titanium, zirconium, niobium, tantalum, tungsten, and vanadium;

Oxides of iron, aluminum, chromium and titanium; and

Phosphides of nickel and niobium.

The ceramic or metallic reinforcements which may be used in accordance with the present invention are normally incorporated in shapes such as, for example, irregular particulates, rods, platelets, long fibers and whiskers. Such reinforcing materials may be incorporated without regard to whether or not they actually arise from, or actually participate in, the combustion synthesis reaction.

The relative amounts of the metal component and the ceramic reinforcement component of the synthesis mixture may be adjusted to achieve desired properties. In general, a high ceramic/low metal synthesis mixture will generally yield a net shaped article having high porosity while a high metal/low ceramic synthesis mixture will give a net shaped product of relatively low porosity and high toughness. Alternatively, porosity may be incorporated to blunt crack propagation.

With regard to the substance containing titanium and boride used in accordance with the present invention, it is preferred that the titanium:boron ratio be in the range of 85:15 plus or minus about 13%.

Examples of the low-melting metal(s) which may be used in accordance with the present invention include, without limitation, copper, niobium, silver, tin, molybdenum, iron and aluminum. Of these, copper and aluminum are preferred.

In a most preferred embodiment, the synthesis mixture contains a substance of titanium and boron wherein the Ti:B ratio is about 85:15 and copper is present in an amount so as to make the overall Ti:B:Cu ratio approximately 68:12:20. The synthesis mixture in such a preferred embodiment also contains at least one of the ceramic reinforcement materials mentioned above.

The synthesis mixture is ignited so as to initiate a combustion synthesis reaction which leads to the production of a metal ceramic composite from the synthesis mixture. The atmosphere in which the combustion synthesis is conducted is not a limitation. In all embodiments described herein, the combustion synthesis may be carried out in or at ambient pressure. In the case of net shaped composites, the synthesis mixture is formed into the desired final shape of the composite (as in net shaped composites), or into a shape sufficiently close to such desired final shape that relatively little post-manufacturing machining is required (as in near-net shaped composites), prior to ignition. As used herein, reference to shape shall be interpreted as exactly or approximately that of the desired article shape depending upon whether a net shaped or near-net shaped article is desired, respectively.

Ignition of the reaction mixture may be accomplished by means of an electric arc, electric spark, flame, welding electrode, microwaves, laser or other conventional means of initiating combustion synthesis. The final product is a metal ceramic composite structure, preferably in the net shaped condition, such shape being selected in accordance with the intended final shape of the composite structure.

The ignition may be done at single or multiple points depending on the shape of the net-shape part to be produced and the amount of distortion to be minimized. Distortion is caused by steep temperatures gradients in the combustion synthesis, so multiple point ignition may be used to reduce temperature gradients at weak points.

The phases formed in the composites of the invention are subject to an interplay between thermodynamic and kinetic control. In addition, the free metallic phase which often acts like a glue to hold the parts together, is able to wet the ceramic phases formed during combustion.

The distortion free character of the metal-ceramic composites of the present invention is, nonexclusively, a function of the component make-up of the combustion composition itself, the technique of ignition, and the combustion parameters. The working examples presented below illustrate this relationship.

With regard to the combustion composition itself, the porosity of the product composite may be controlled by the ratio of the low melting metal component of the combustion composition. In general, the greater the amount of the low-melting metal component the lower the porosity while lesser amounts of the low-melting metal component yield higher porosity composites. Accordingly, the present invention allows for porosity of the composite to be controlled.

In addition, both composition and process control can be employed to control distortion and properties of the net shaped material. Example 2 below discusses this effect in detail.

Other parameters which affect the distortion free nature of the composites include the preignition temperature, the temperature of the ignition, the density of the combustion synthesis mixture (for example, the degree to which a combustion synthesis powder slurry is compressed prior to ignition), the number of ignition points and the type of ignition (i.e. point or area sources).

DETAILED DESCRIPTION OF THE PREFERRED EMBODIMENT

The following illustrative but non-limiting embodiments of the present invention represent its preferred embodiments:

EXAMPLE 1

Figure 2:
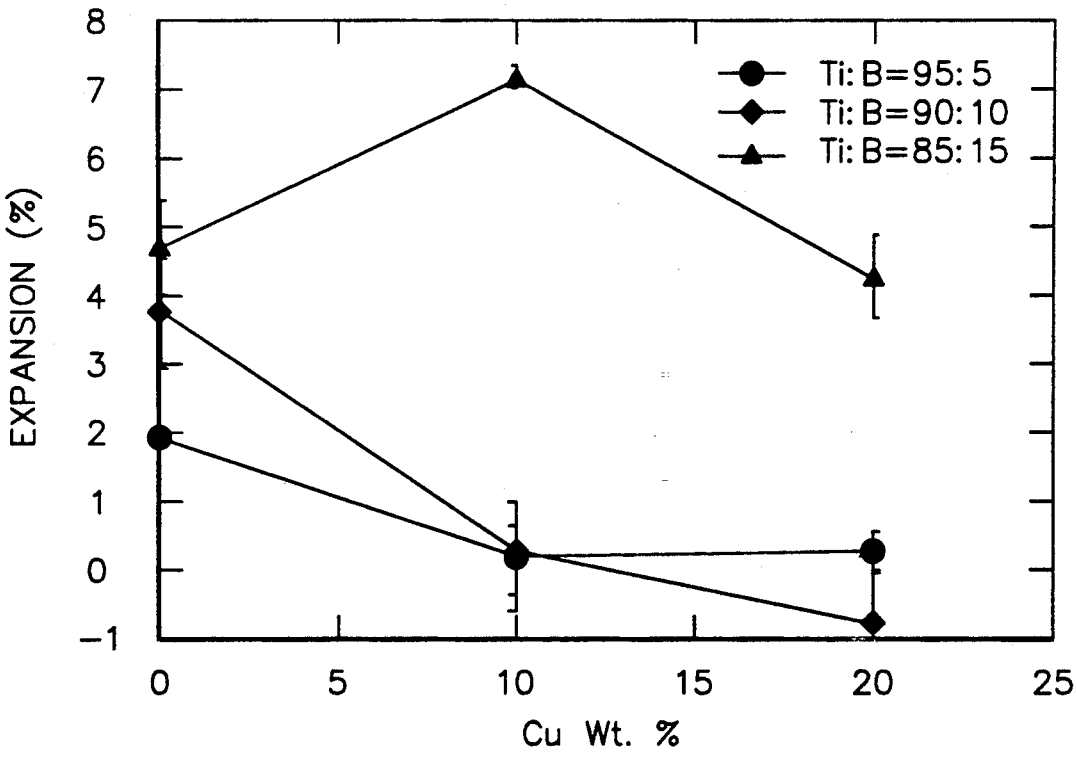
FIG. 2 is a graph of expansion values (in percent) as a function of percent by weight content of copper.
Figure 5:
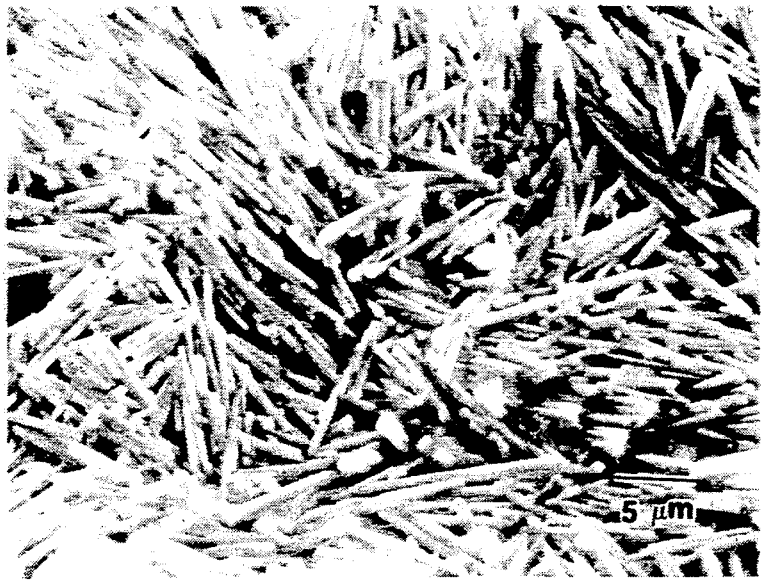
FIG. 5 is a photomicrograph of a metal ceramic composite made in accordance with one embodiment of the invention.

For producing net shaped composites, mixtures were prepared from Ti powder (particle size −325 mesh), amorphous B (particle size −325 mesh) and Cu (particle size −100 mesh) in various ratios. The various compositions were mixed in plastic bottles in rubber ball mills for 14 hours. Batch size was kept within 10 gms so as to maintain homogeneity of the comparisons. These mixed batches were poured in a double acting die of the shape of standard test specimen for metal powder product (ASTM-E8M) as shown in FIG. 1 and Table 1. Samples were pressed at 15000 psi using a hydraulic press. After ejecting the sample from the die, they were ignited either using a welding electrode or oxy-acetylene torch. Because of the exothermic reaction involved, the combustion front rapidly propagated through the sample. The expansion values were measured between two fiduciary marks in the as pressed samples and as combustion samples. The length between the two marks in the new and old samples were calculated and their ratios (in terms of percentage) were determined. The final phases were found to comprise TiB, $TiB_2$, TiCu, $Ti_3Cu$, Ti and Cu. The relative amounts of these phases could be controlled by composition of the combustion synthesis mixture and the preignition temperature thereof. FIG. 2 shows the various expansion values. These vary from negative to zero to a maximum of 7% demonstrating the net shaped processing capability of the disclosed technology. Sometimes in situ fibers were noted in the net shaped article after being cut open. FIG. 5 shows a photomicrograph of such fibers.

EXAMPLE 2

Figure 3:
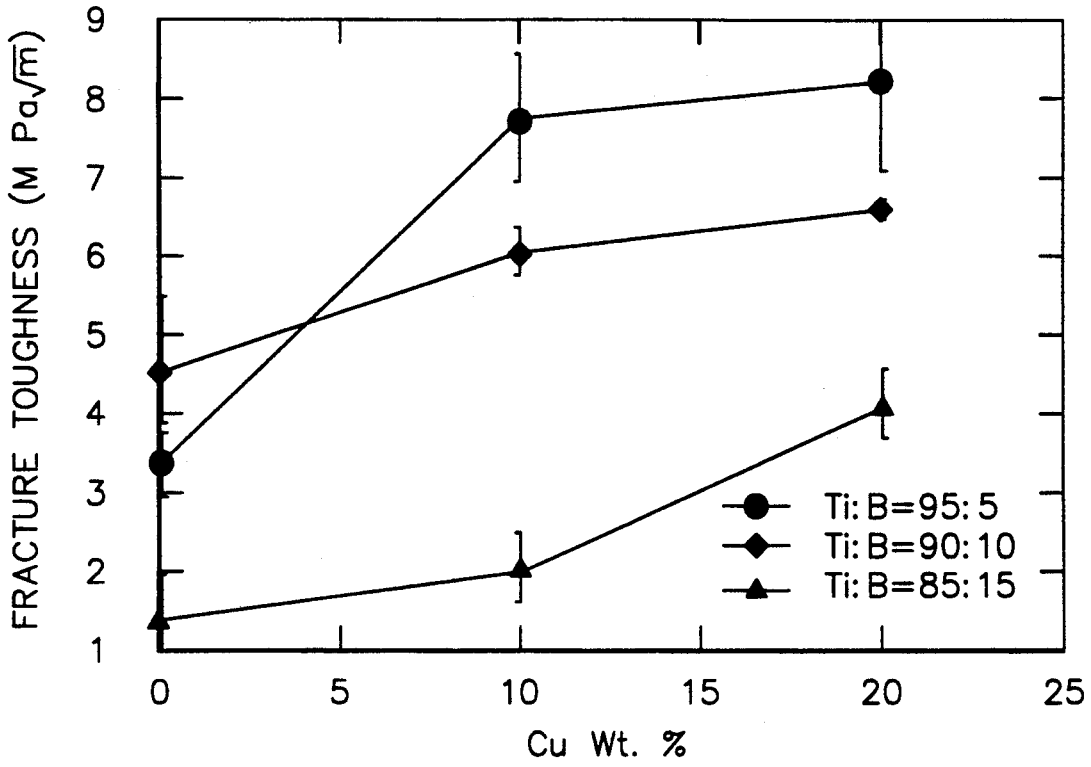
FIG. 3 is a graph of toughness fracture (M; $K_{1C}$ $=MPa\sqrt{m}$) as a function of percent by weight content of copper.
Figure 4:
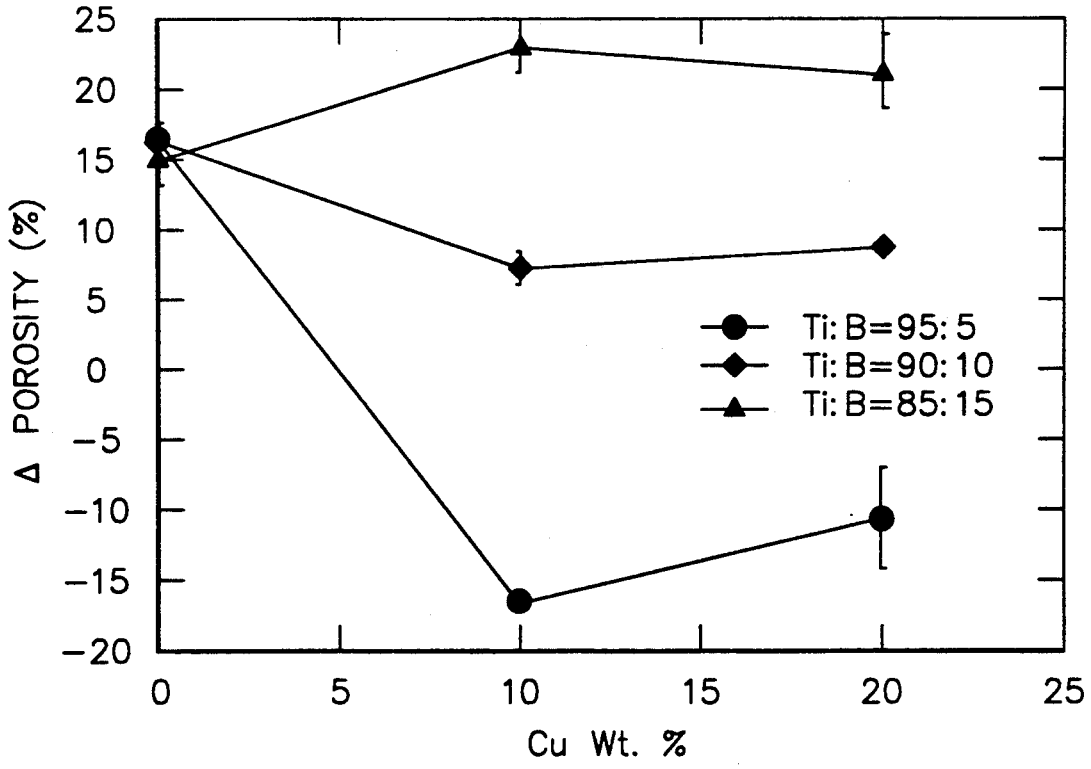
FIG. 4 is a graph of the change in porosity (expressed in percent) as a function of percent by weight content of copper.

Samples were fabricated as the procedure of Example 1. The apparent porosities of the samples were determined using Archimedes Principle. The fracture toughness of these materials were determined using notched beam technique using a four point bending jig and a universal testing machine filled with a compression load cell. The toughness and the change in porosity values from the green compact are shown in FIG. 3 and FIG. 4. This demonstrates that in the process as described the porosity can be reduced on combustion. Example 7 below shows the near complete elimination of porosity by composition control techniques. A detailed examination of the high toughness values (by X-ray and metallography) indicated that the high values were a consequence of the retention of the ductile Ti and Cu phases.

EXAMPLE 3

A mixture was prepared with Ti:B:Cu in the ratio 17:3:80. The tensile sample was prepared using the method of Example 2. After ignition, the contraction of the sample was 4.8%. The porosity and fracture toughness values were 12.98% and $9.5 MPa(m)^{\frac{1}{2}}$.

EXAMPLE 4

Several compositions were also prepared incorporating short and long fiber reinforcements, e.g. 50 Vol.% SiC whiskers were incorporated into a mixture (Ti:B:Cu=72:8:20) of powders and ignited to obtain a fiber reinforced net shaped engineered composite.

EXAMPLE 5

Similarly soft and hard particles could be easily incorporated into the powder mixture soft particles being used to increase the toughness of the composites. Experiments were carried out with 30% Wt. of BN (−100 mesh) particles and $Al_2O_3$ (0.03–44 μm) powders in a Ti:B:Cu=72:8:20 mixture. In all instances a net shaped composite was obtained.

EXAMPLE 6

Figure 8:
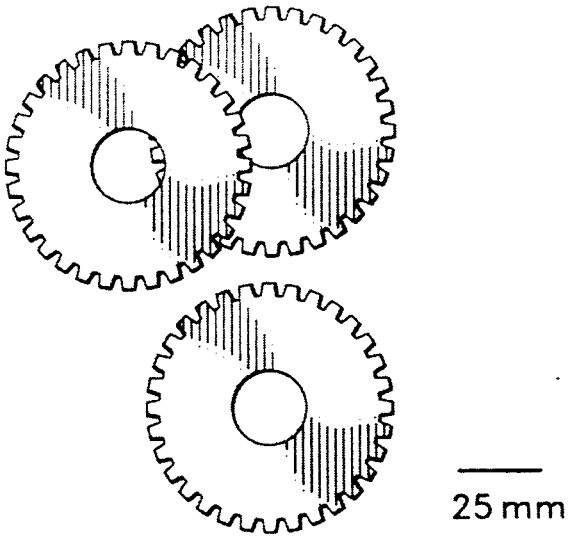
FIG. 8 is a photograph of three gears produced in accordance with the present invention.

A gear shaped product was fabricated using the process of Example 1. The composition used was Ti:B:Cu−85.5:4.5:10. The as ignited net shaped components are shown in FIG. 8. The percentage increase in radius from green compact to the final gear was about 1%.

EXAMPLE 7

A Ti:Nb:Cu:B:Al combustible mixture was made in a ratio of 15:2:50:3:30 and ignited at room temperature in a shape similar to Example 2. The final net shaped composite consisted of TiB, $TiB_2$, NbB and $NbB_2$ as the reinforcing phase in a predominantly metallic matrix. The final porosity in the specimen was only ≃3%. This Example demonstrates that a low porosity material can be obtained by composition control techniques while involving a liquid phase and subsequent solidification.

EXAMPLE 8

The following composites A-F were made into net shaped gears. Porosity in all cases was less than 3% without any pressure application during or after combustion.

| | A | B | C | D | E | F |
|---|---|---|---|---|---|---|
| Ti | 10.6 | 10.6 | 10.6 | 11.7 | 11.7 | 11.7 |

-continued

| | A | B | C | D | E | F |
|---|---|---|---|---|---|---|
| B | 4.7 | 6.7 | 4.7 | 5.2 | 5.2 | 5.2 |
| Cu | 28.2 | 9.4 | 67.1 | 20.8 | 31.2 | 41.5 |
| Al | 56.5 | 75.2 | 37.6 | 62.3 | 51.9 | 41.5 |

The CuAlTi intermetallic phase formed during combustion were often in the form of short fibers.

Figure 6:
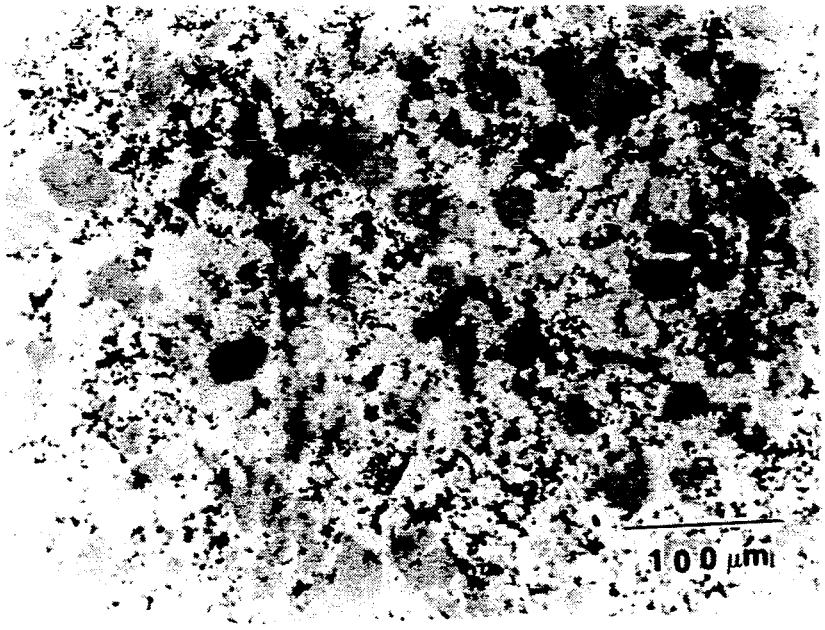
FIG. 6 is a photomicrograph of a metal ceramic composite made in accordance with another embodiment of the invention.
Figure 7:
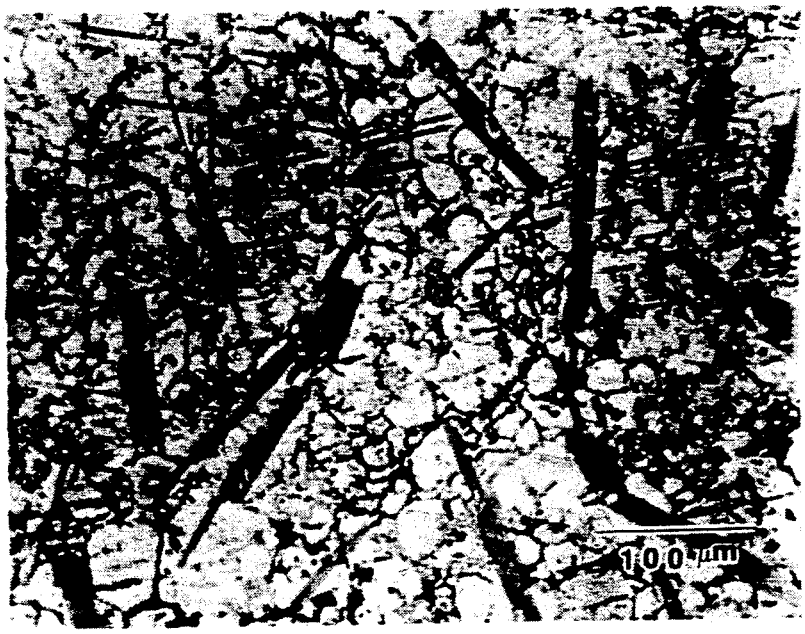
FIG. 7 is a photomicrograph of a metal ceramic composite made in accordance with yet another embodiment of the invention.

Photomicrographs showing the different microstructures of composites A and B are shown in FIGS. 6 and 7 respectively. The differences in microstructure, with particular regard to porosity, can be seen in these Figures, Composite A having less porosity than Composite B.

EXAMPLE 9

The procedure of Example 1 was carried out with the exception that the initial mixture was comprised of powders of Al, $TiO_2$ and $B_2O_3$. The net shaped article after combustion contained Al, TiB, $TiB_2$ and AlTi and was extremely tough.

TABLE 1

| The Dimension of Specimen | |
|---|---|
| Dimensions | mm |
| G - Gage length | 24.00 ± 0.1 |
| D - Width at center | 6.00 ± 0.03 |
| W - Width at end of reduced section | 6.25 ± 0.03 |
| T - Compact to this thickness | 5 to 6.5 |
| R - Radius of fillet | 25 |
| A - Half-length of reduced section | 16 |
| B - Grip length | 81 |
| L - Overall length | 90 |
| C - Width of grip section | 9.00 ± 0.03 |
| F - Half width of grip section | 4.50 ± 0.03 |
| E - End radius | 4.50 ± 0.03 |

In light of the foregoing disclosure and exemplary embodiments, variations or modification will be within the reach of one of ordinary skill, and may be made without departing from the spirit of the invention.

What is claimed is:

1. A method of producing a net shaped metal ceramic composite having an intended final shape comprising preparing a mixture of:

(a) at least one combustible powder which, when ignited, is capable of forming a ceramic, and (b) at least one low melting point metal; forming said mixture into said intended final shape in a die, removing said mixture from said die and igniting said mixture so as to produce a distortion-free net shaped metal ceramic composite by combustion synthesis having an expansion or contraction of not more than about 7% from said intended final shape.

2. The method according to claim 1 wherein said at least one combustible powder comprises a mixture of titanium and boron.

3. The method according to claim 2 wherein the weight ratio of titanium to boron in said combustible powder containing titanium and boron is in the range of 85:15, plus or minus about 13%.

4. The method according to claim 2 wherein said low-melting point metal is selected from the group consisting of the metals copper, niobium, aluminum, iron and molybdenum; and mixtures thereof.

5. The method according to claim 4 wherein said low-melting point metal is copper.

6. The method according to claim 5 wherein the weight ratio of titanium to boron to copper in said mixture is about 68:12:20.

7. The method according to claim 1 wherein said mixture additionally comprises at least one ceramic or metallic reinforcement.

8. The method of claim 7 wherein said at least one ceramic or metallic reinforcement is selected from the group consisting of:

borides of titanium, zirconium, niobium, tantalum, molybdenum, hafnium, chromium, and vanadium;

carbides of titanium, hafnium, boron, aluminum, tantalum, silicon, tungsten, zirconium, niobium, and chromium;

nitrides of titanium, zirconium, boron, aluminum, silicon, tantalum, hafnium, and niobium;

silicides of molybdenum, titanium, zirconium, niobium, tantalum, tungsten, and vanadium;

oxides of iron, aluminum, chromium and titanium; and phosphides of nickel and niobium.

9. A method of producing a net shaped metal ceramic composite having an intended final shape comprising preparing a mixture of:

(a) a combustible substance containing titanium and boron, the weight ratio of said titanium to said boron in said substance being in the range of 85:15, plus or minus about 13%; and (b) copper present in an amount such that the overall weight ratio of said titanium to said boron to said copper in said mixture is about 68:12:20; forming said mixture into said intended final shape, and igniting said mixture so as to produce a distortion-free net shaped metal ceramic composite by combustion synthesis having an expansion or contraction of not more than about 7% from said intended final shape.

10. The method according to claim 9 wherein said mixture additionally comprises at least one ceramic reinforcement capable of undergoing said combustion synthesis so as to produce said net shaped metal ceramic composite.

11. The method of claim 10 wherein said at least one ceramic reinforcement is selected from the group consisting of:

borides of titanium, zirconium, niobium, tantalum, molybdenum, hafnium, chromium, and vanadium;

carbides of titanium, hafnium, boron, aluminum, tantalum, silicon, tungsten, zirconium, niobium, and chromium;

nitrides of titanium, zirconium, boron, aluminum, silicon, tantalum, hafnium, and niobium;

silicides of molybdenum, titanium, zirconium, niobium, tantalum, tungsten, and vanadium;

oxides of iron, aluminum, chromium and titanium; and phosphides of of nickel and niobium.

12. A method of producing a net shaped metal ceramic composite having an intended final shape comprising preparing a mixture of:

(a) a combustible substance containing titanium and boron, the weight ratio of said titanium to said boron in said substance being in the range of 85:15, plus or minus about 13%;

(b) copper present in an amount such that the overall weight ratio of said titanium to said boron to said copper in said mixture is about 68:12:20; and (c) at least one ceramic reinforcement selected from the group consisting of:

borides of titanium, zirconium, niobium, tantalum, molybdenum, hafnium, chromium, and vanadium;

carbides of titanium, hafnium, boron, aluminum, tantalum, silicon, tungsten, zirconium, niobium, and chromium;

nitrides of titanium, zirconium, boron, aluminum, silicon, tantalum, hafnium, and niobium;

silicides of molybdenum, titanium, zirconium, niobium, tantalum, tungsten, and vanadium;

oxides of iron, aluminum, chromium and titanium; and phosphides of nickel and niobium;

forming said mixture into said intended final shape and igniting said mixture so as to produce a distortion-free net shaped metal ceramic composite by combustion synthesis having an expansion or contraction of not more than about 7% from said intended final shape.

* * * * *